US005713089A

United States Patent [19]

Ferrante

[11] Patent Number: 5,713,089

[45] Date of Patent: Feb. 3, 1998

[54] MODULAR QUILT

[76] Inventor: Louise Ferrante, P.O. Box 236, N. Salem, N.Y. 10560

[21] Appl. No.: 768,173

[22] Filed: Dec. 17, 1996

[51] Int. Cl.[6] ..... A47G 9/04

[52] U.S. Cl. ..... 5/502; 5/486; 5/923

[58] Field of Search ..... 5/502, 486, 923, 5/482, 499, 495

[56] References Cited

U.S. PATENT DOCUMENTS

| | | | |
|---|---|---|---|
| 1,267,042 | 5/1918 | Arnold | 5/486 |
| 3,063,749 | 11/1962 | Struble et al. | 5/923 |
| 3,508,285 | 4/1970 | Marguette | 5/486 |
| 4,069,526 | 1/1978 | Deikel | 5/486 |
| 4,573,227 | 3/1986 | Prandina | 5/502 |
| 4,631,765 | 12/1986 | Casey | 5/502 |
| 4,839,934 | 6/1989 | Rojas | 5/502 |
| 4,878,258 | 11/1989 | Casey | 5/502 |
| 5,199,121 | 4/1993 | Payne | 5/502 |
| 5,251,350 | 10/1993 | Bordenave, Sr. | 5/502 |

FOREIGN PATENT DOCUMENTS

| | | | |
|---|---|---|---|
| 022951 | 11/1993 | WIPO | 5/502 |

*Primary Examiner*—Alexander Grosz

[57] ABSTRACT

A modular construction for quilted blankets uses long panels which are releasably connected together in a side by side manner through interlocking hook and loop type fasteners. On one long side of each panel a tongue strip is secured to extend from between fabric sheets of the panel. Hooks and/or loops are provided along the length of the tongue strip. On the other long side of each panel a groove is formed by the bifurcation of the fabric sheets. Within this grove, loops and/or hooks are provided to coact with their opposing members on the tongue strip. The tongue strip of one panel is interlocked within the groove of an adjacent panel. A capping strip with loops and/or hooks is doubled over to cover the remaining exposed tongue strip to finish the blanket. By adding or subtracting panels, the size of the blanket may be varied as desired.

6 Claims, 3 Drawing Sheets

MODULAR QUILT

BACKGROUND OF THE INVENTION

1. Field of the Invention

The present invention relates to blanket assemblies. More specifically, the present invention relates to quilted blankets which may be expanded by the addition of sections.

2. Description of the Prior Art

Blankets and the like are typically sized for a particular environment. Thus, one made for a double bed would be too small for a king-sized bed. However, if a blanket is made sufficiently large for a large bed, it losses flexibility for other uses, such as for a couch throw or as a lap blanket.

Quilted blankets are particularly desirable for their comfort, as well as their aesthetic appeal. Due to the amount of labor and materials required to produce quilted materials, it can become prohibitively expensive to purchase multiple blankets to serve each individual environment, or to replace a perfectly serviceable item when bedding of a different size is acquired. Further, storage for the bulky quilted material may be a premium ill afforded by many people.

Various prior art attempts have been made to provide blankets which are interconnectable to form a larger whole. For example, U.S. Pat. No. 4,573,227, issued Mar. 4, 1986 to A. Prandina describes single bed blankets which are slightly overlapped and buttoned together to form a double bed blanket. The overlapping area is of double thickness, which is not particularly desirable. U.S. Pat. No. 4,069,525, issued Jan. 24, 1978 to T. Deikel describes a bed covering apparatus that includes multiple coverlet members which may be attached to hinge across a single edge. Similarly, U.S. Pat. No. 3,508,285, issued Apr. 28, 1970 to E. Marquette describes a bed blanket which may be made of multiple panels to provide varying thickness on one side. An interchangeable bedspread that includes reversible panels with connectors is described in U.S. Pat. No. 5,251,350, issued Oct. 12, 1993 to D. Bordenave, Sr. et al. As shown, the bedspread includes a pair of side panels and a central panel. Though the patent describes interchanging a given panel for another, side and central panels are not so interchangeable.

Other patents describe various sectional assemblies for blankets, comforters, and the like. For example, U.S. Pat. No. 4,839,934, issued Jun. 20, 1989 to R. Rojas describes a multiple component comforter that is held together by connector strips. Though individual components may include removable pad units, the comforter as a whole remains the same size. U.S. Pat. No. 5,199,121, issued Apr. 6, 1993 to A. Payne describes a comforter with an outer fabric shell and various interior connectors which may be released to allow filling material to be redistributed.

SUMMARY OF THE INVENTION

The present invention relates to a quilted blanket assembly in which multiple quilted panel sections are used along with a single capping strip. Each of the panel sections are connected to an adjoining panel section through substantially the same fastening mechanism, thereby simplifying construction, as well as providing true interchangeability of any panel section for any other.

The quilted panel sections are of rectangular dimension with two long edges and two short edges. The long edge or length of each panel section may be of standard length for bedding, typically about 90". The short edge of each panel or width may be selected such that multiples of the short edge are standard widths for bedding. For example, from about 30" to 40" for a throw, about 60" in width for a twin bed, about 80" to 90" for a queen bed, etc. Accordingly, the short edge or width is preferably from about 20" to about 30".

Each panel section includes an upper fabric sheet and a lower fabric sheet with filler material therebetween to form a quilt material. Any pattern or design may be selected for these fabric sheets, which may be whole cloth, or piece work, as desired. Further, any desired stitch work may be used; both to secure the filler material as needed as well as to provide a desired appearance. The upper and lower fabric sheets need not be identical if a reversible quilt is desired.

Along the entire length of one of the long edges of each panel section, an exposed tongue strip is secured. This strip includes at least one member of a fastener pair thereon. Along the entire length of the other of the long edges, a groove is formed by the separation of the upper and lower fabric sheets. At least the other member of a fastener pair is provided within the groove. Accordingly, the tongue strip of one panel section may be secured within the groove of another panel section, to easily and quickly expand the present quilted blanket to a desired size.

Finally, a capping strip is provided which may be secured to conceal the exposed tongue strip of the last panel section. The capping strip includes fastener members identical to those provided in the groove of the panel sections.

Accordingly, it is a principal object of the invention to provide an expandable quilt blanket composed of panel sections which may be added or removed as desired.

It is another object of the invention to provide a quilt blanket in which panel sections may be truly interchanged for each other.

It is a further object of the invention to provide a quilt blanket in which interconnections between panel sections utilize fastener assemblies which are hidden in a tongue and groove construction.

Still another object of the invention is to provide a quilt blanket with a capping strip for a complete finished appearance.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
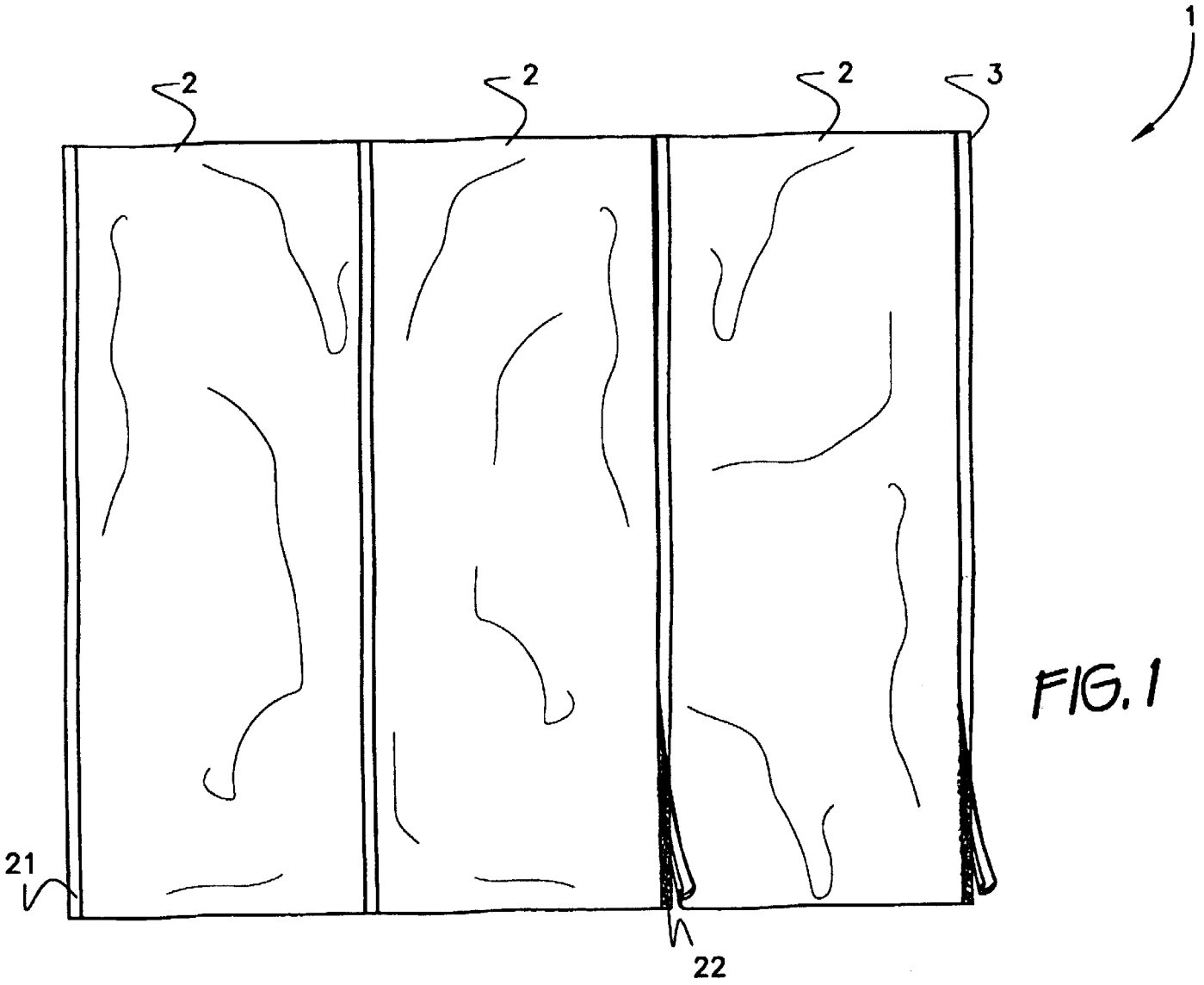
FIG. 1 is a top view of one preferred embodiment of the present quilted blanket.

As shown in FIG. 1, the present invention is a modular quilted blanket 1 that includes a plurality of panel sections 2 and a capping strip 3. Panel sections may be added and deleted as desired to accommodate various environments, such as beds of different sizes. Further, panel sections of any desired color, design, and filler weight may be interchangeably used in the present invention. The preferred embodiment shown has three panel sections, each of about 90" in length and 20" in width, secured together to form a blanket suitable for a twin bed. It is envisioned that additional panel sections may be made available on an individual basis, which may be acquired and added to the embodiment shown.

Figure 2:
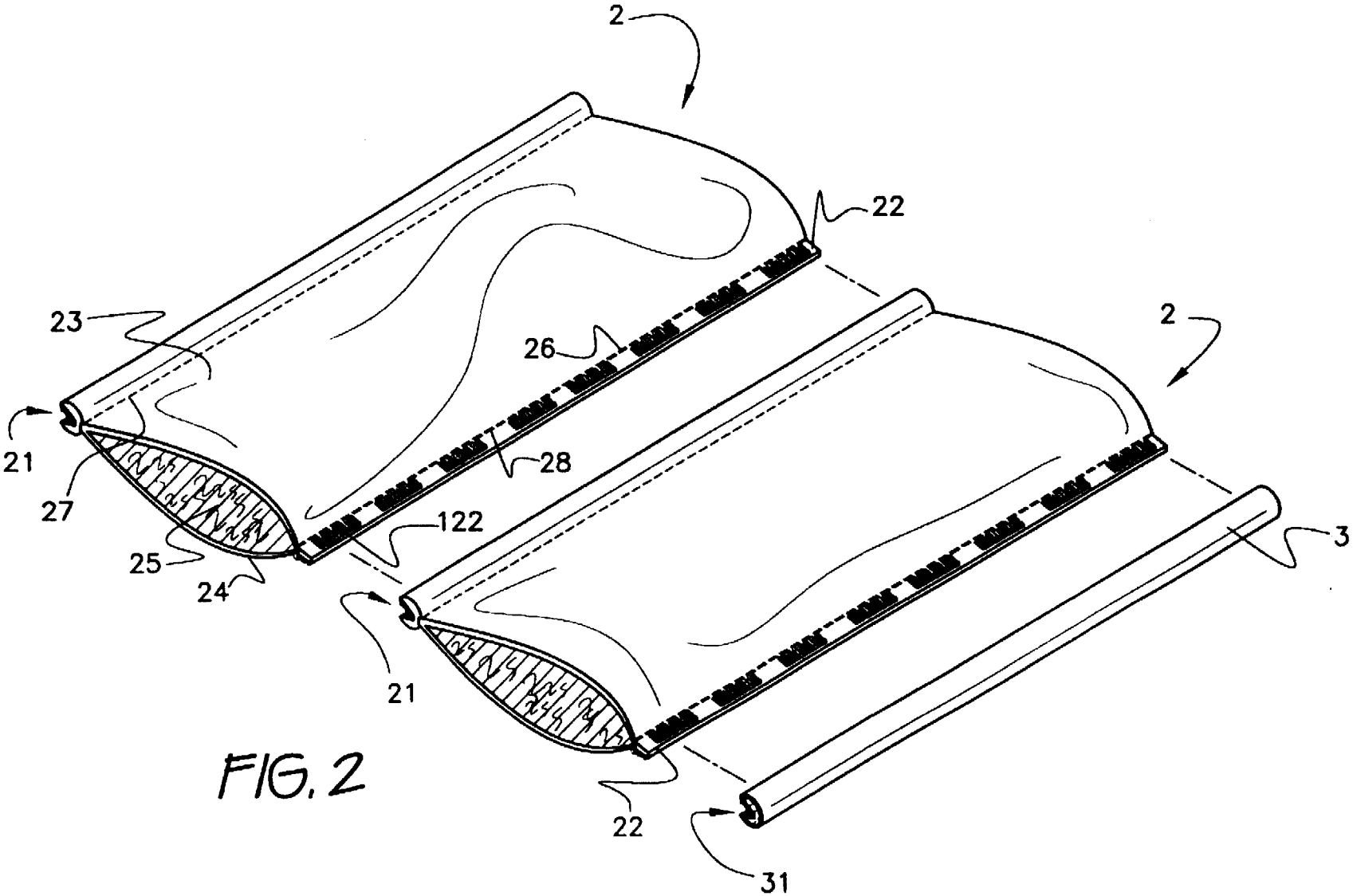
FIG. 2 is a perspective view of two panel sections and a capping strip of the quilted blanket above.

As best seen in FIG. 2, each panel section is made from a top fabric sheet 23, filling 25, and a bottom fabric sheet 24, which may be secured together by panel body stitching 26, in a typical quilted manner. Each of the panel sections 2 has a first long edge with a panel groove 21, formed by the bifurcation of the top and bottom fabric sheets beyond a lengthwise groove stitching 27. A second long edge parallel the first long edge includes a tongue strip 22, secured between the top and bottom fabric sheets by a lengthwise tongue stitching 28. Capping strip 3 is of the same length as the panel sections and is doubled over to form a capping groove 31. As can be seen, only one capping strip is required, regardless the number of panel sections used in a single blanket.

Figure 3:
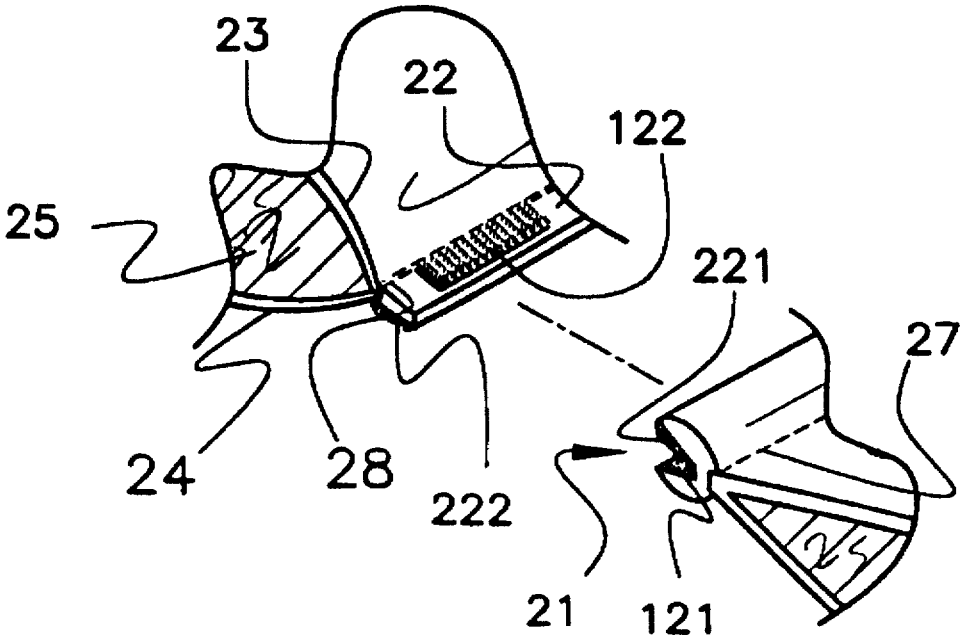
FIG. 3 is a side partial sectional view showing the tongue and groove fastener construction in two panel sections of the quilted blanket above.

As best seen in FIG. 3, the tongue strip 22 of one panel section 2 is secured to the panel groove 21 of another panel section through first fasteners provided on the surface of the tongue strip and second fasteners within the groove. The first and second fasteners coact to provide a releasable attachment. Preferably, the fasteners are of the hook and loop variety as shown.

Most preferably, one surface of the exposed tongue strip includes tongue hooks 122, and the other surface of the tongue strip includes tongue loops 222. These may be provided continuously along the tongue strip, or in discrete groups. The interior of panel groove 21 would accordingly carry panel groove loops 221 and panel groove hooks 121 for releasably securing to tongue hooks 122 and tongue loops 222, respectively. This particular arrangement of hook and loop fasteners is advantageous both for its security and because the panel groove of a leftmost panel section (as depicted) may be closed on itself in a releasable manner to more effectively hide these fasteners.

Figure 4:
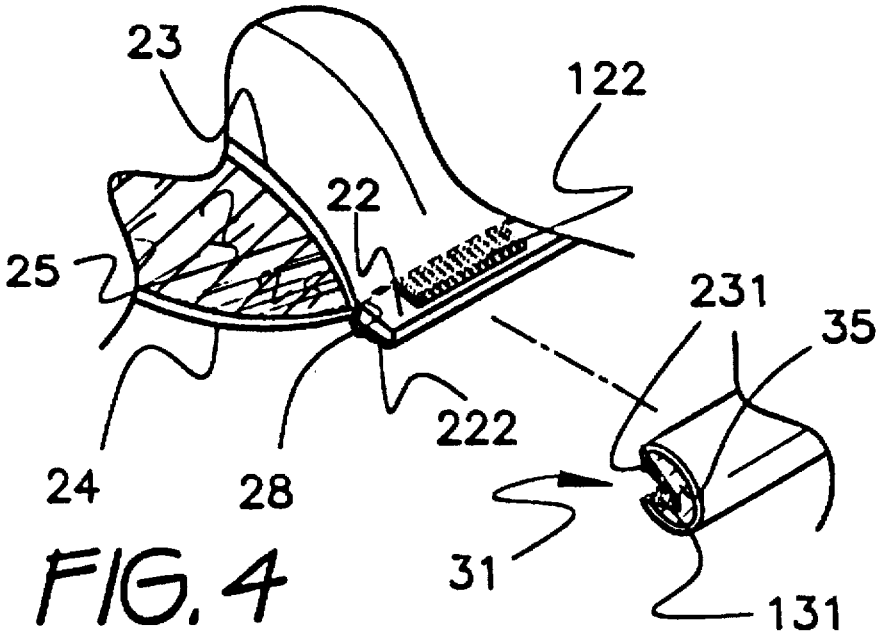
FIG. 4 is a side partial sectional view showing the tongue and groove fastener construction between a panel section and a capping strip of the quilted blanket above.

Similarly, as shown in FIG. 4, the capping groove 31 includes capping groove loops 231 and capping groove hooks 131, for securing the capping strip to the tongue strip of an end panel section. These capping groove hooks and loops may be provided in parallel bands along the length of the capping strip, such that when doubled over, one is disposed over the other, as shown.

As also seen in FIGS. 3 and 4, additional filling may be provided in either the panel groove portion or in the capping strip. This may be accomplished in the panel groove portion by doubling over the top and bottom fabric sheets 23 and 24, prior to applying groove stitching 27. For the capping strip, a tubular fabric construction with a core of filler 35 may be used. Alternatively, a pair of fabric strips may be stitched together with filler 35 provided therebetween.

It is to be understood that the present invention is not limited to the any single embodiment described above, but encompasses any and all embodiments within the scope of the following claims.

I claim:

1. A modular quilted blanket assembly comprising:

a plurality of panel sections, each of said panel sections having a first long edge bifurcated to form a panel groove and a second long edge parallel said first long edge;

a tongue strip secured to said second long edge, said tongue strip having an exposed portion sized to be received in said panel groove;

a capping strip sized to cover said exposed portion of said tongue strip when doubled over to form a capping groove;

first fastening means provided on said exposed portion of said tongue strip; and second fastening means provided within said panel groove and said capping groove;

wherein said first fastening means coact with said second fastening means to releasably secure said tongue in one of said panel groove and said capping groove, such that the first long edge of one of said plurality of panel sections may be releasably secured next to a second long edge of another of said plurality of panel sections, and said second long edge may be releasably secured to said capping strip.

2. The modular quilted blanket of claim 1, wherein said first fastening means and said second fastening means are each selected from hooks and loops of a hook and loop type fastener.

3. The modular quilted blanket of claim 2, wherein said first fastening means includes tongue hooks on one surface of the exposed portion of said tongue strip and tongue loops on an opposite surface of said exposed portion of said tongue strip.

4. The modular quilted blanket of claim 1, wherein:

each of said panel sections further comprises a top fabric sheet, a bottom fabric sheet, and filling disposed between said top fabric sheet and said bottom fabric sheet;

said tongue strip is secured between said top fabric sheet and said bottom fabric sheet, to extend beyond the second long edge thereof; and said panel groove on said first long edge is defined on one side by said top fabric sheet and on the other side by said bottom fabric sheet.

5. The modular quilted blanket of claim 4, wherein said first fastening means and said second fastening means are selected from hooks and loops of a hook and loop type fastener.

6. The modular quilted blanket of claim 5, wherein:

said first fastening means includes hooks on one surface of the exposed portion of said tongue strip and loops on an opposite surface of said exposed portion of said tongue strip;

said second fastening means includes panel groove hooks, panel groove loops, capping groove hooks, and capping groove loops;

said panel groove hooks attached to one of said top fabric sheet and said bottom fabric sheet and said panel groove loops to the other of said top fabric sheet and said bottom fabric sheet; and said capping groove hooks and capping groove loops are disposed in parallel bands along one side of said capping strip.

* * * * *